US006533020B2

(12) United States Patent
Shade

(10) Patent No.: US 6,533,020 B2
(45) Date of Patent: Mar. 18, 2003

(54) CASTING OF ENGINE BLOCKS

(75) Inventor: Larry R. Shade, Stryker, OH (US)

(73) Assignee: General Motors Corporation, Detroit, MI (US)

( * ) Notice: Subject to any disclaimer, the term of this patent is extended or adjusted under 35 U.S.C. 154(b) by 0 days.

(21) Appl. No.: 09/878,776

(22) Filed: Jun. 11, 2001

(65) Prior Publication Data

US 2002/0185250 A1 Dec. 12, 2002

(51) Int. Cl.[7] ..... B22D 33/04; B22D 17/24

(52) U.S. Cl. ..... 164/137; 164/340; 164/9; 164/11; 164/332; 164/333; 164/338; 164/369

(58) Field of Search ..... 164/137, 340, 164/9, 11, 332, 333, 368, 369

(56) References Cited

U.S. PATENT DOCUMENTS

| | | | | |
|---|---|---|---|---|
| 4,693,292 A | | 9/1987 | Campbell | 164/34 |
| 4,938,183 A | | 7/1990 | Field et al. | 123/193 |
| 4,967,827 A | | 11/1990 | Campbell | 164/134 |
| 5,163,500 A | | 11/1992 | Seaton et al. | 164/130 |
| 5,215,141 A | | 6/1993 | Kuhn et al. | 164/457 |
| 5,320,158 A | | 6/1994 | Helgesen | 164/76.1 |
| 5,361,823 A | | 11/1994 | Kuhn et al. | 164/9 |
| 5,365,997 A | | 11/1994 | Helgesen et al. | 164/103 |
| 5,477,906 A | | 12/1995 | Legge et al. | 164/122.1 |
| 5,522,447 A | * | 6/1996 | Sandstrom et al. | 164/228 |
| 5,771,955 A | * | 6/1998 | Helgesen et al. | 164/9 |
| 5,924,470 A | | 7/1999 | Costilla-Vela et al. | 164/4.1 |
| 6,003,588 A | * | 12/1999 | Dang et al. | 164/137 |

FOREIGN PATENT DOCUMENTS

| | | | | |
|---|---|---|---|---|
| DE | 3624554 | * | 1/1988 | 164/369 |
| EP | 1 002 602 | | 5/2000 | |

* cited by examiner

*Primary Examiner*—Tom Dunn
*Assistant Examiner*—I.-H. Lin
(74) *Attorney, Agent, or Firm*—Kathryn A. Marra

(57) ABSTRACT

An engine block mold package is assembled from resin-bonded sand cores in a manner that reduces contamination of the engine block cast in the mold package by loose sand abraded off the cores during assembly. An assembly of multiple cores (core package) of the engine block mold package is formed apart from a base core. The core package is cleaned to remove loose sand therefrom. The cleaned core package then is positioned on the base core followed by assembly of a cover core to complete the engine block mold package for casting of an engine block therein.

13 Claims, 10 Drawing Sheets

CASTING OF ENGINE BLOCKS

FIELD OF THE INVENTION

The present invention relates to precision sand casting of engine cylinder blocks, such as engine cylinder V-blocks, with cast-in-place cylinder bore liners.

BACKGROUND OF THE INVENTION

In the manufacture of cast iron engine V-blocks, a so-called integral barrel crankcase core has been used and consists of a plurality of barrels formed integrally on a crankcase region of the core. The barrels form the cylinder bores in the cast iron engine block without the need for bore liners.

In the precision sand casting process of an aluminum internal combustion engine cylinder V-block, an expendable mold package is assembled from a plurality of resin-bonded sand cores (also known as mold segments) that define the internal and external surfaces of the engine V-block. Each of the sand cores is formed by blowing resin-coated foundry sand into a core box and curing it therein.

Traditionally, in past manufacture of an aluminum engine V-block with cast-in-place bore liners, the mold assembly method for the precision sand process involves positioning a base core on a suitable surface and building up or stacking separate crankcase cores, side cores, barrel cores with liners thereon, water jacket cores, front and rear end cores, a cover (top) core, and other cores on top of the base core or on one another. The other cores can include an oil gallery core, side cores and a valley core. Additional cores may be present as well depending on the engine design.

During assembly or handling, the individual cores may rub against one another at the joints therebetween and result in loss of a small amount of sand abraded off the mating joint surfaces. Abrasion and loss of sand in this manner is disadvantageous and undesirable in that the loose sand may fall onto the base core, or may become trapped in small spaces within the mold package, contaminating the casting.

Additionally, when fully assembled, the typical engine V-block mold package will have a plurality of parting lines (joint lines) between mold segments, visible on the exterior surface of the assembled mold package. The external parting lines typically extend in myriad different directions on the mold package surface. A mold designed to have parting lines extending in myriad directions is disadvantageous in that if contiguous mold segments do not mate precisely with each other, as is often observed, molten metal can flow out of the mold cavity via the gaps at the parting lines. Molten metal loss is more prone to occur where three or more parting lines converge.

The removal of thermal energy from the metal in the mold package is an important consideration in the foundry process. Rapid solidification and cooling of the casting promotes a fine grain structure in the metal leading to desirable material properties such as high tensile and fatigue strength, and good machinability. For those engine designs with highly stressed bulkhead features, the use of a thermal chill may be necessary. The thermal chill is much more thermally conductive than foundry sand. It readily conducts heat from those casting features it contacts. The chill typically consists of one or more steel or cast iron bodies assembled in the mold in a manner to shape some portion of the bulkhead features of the casting. The chills may be placed into the base core tooling and a core formed about them, or they may be assembled into the base core or between the crankcase cores during mold assembly.

It is difficult to remove chills of this type from the mold package after the casting is solidified, and prior to heat treatment, because the risers are encased by the sand of the mold package, and may also be entrapped between the casting and some feature of the runner or risering system. If the chills are allowed to remain with the casting during heat treatment, they can impair the heat treatment process. The use of slightly warm chills at the time of mold filling is a common foundry practice. This is done to avoid possible condensation of moisture or core resin solvents onto the chills, which can lead to significant casting quality problems. It is difficult to "warm" the type of chill described above, as a result of the inherent time delay from mold assembly to mold filling.

Another method to rapidly cool portions of the casting involves using the semi-permanent molding (SPM) process. This method employs convective cooling of permanent mold tooling by water, air or other fluid. In the SPM process, the mold package is placed into the SPM machine. The SPM machine includes an actively cooled permanent (reusable) tool designed to shape some portion of the bulkhead features. The mold is filled with metal. After several minutes have passed, the mold package and casting are separated from the permanent mold tool and the casting cycle is repeated. Such machines typically employ multiple molding stations to make efficient use of the melting and mold filling equipment. This leads to undesirable system complexity and difficulty in achieving process repeatability.

In past manufacture of an aluminum engine V-block with cast-in-place bore liners using separate crankcase cores and barrel cores with liners thereon, the block must be machined in a manner to insure, among other things, that the cylinder bores (formed from the bore liners positioned on the barrel features of the barrel cores) have uniform bore liner wall thickness, and other critical block features are accurately machined. This requires the liners to be accurately positioned relative to one another within the casting, and that the block is optimally positioned relative to the machining equipment.

The position of the bore liners relative to one another within a casting is determined in large part by the dimensional accuracy and assembly clearances of the mold components (cores) used to support the bore liners during the filling of the mold. The use of multiple mold components to support the liners leads to variation in the position of the liners, due to the accumulation, or "stack-up" of dimensional variation and assembly clearances of the multiple mold components.

To prepare the cast V-block for machining, it is held in either a so-called OP10 or a "qualification" fixture while a milling machine accurately prepares flat, smooth reference sites (machine line locator surfaces) on the cast V-block that are later used to position the V-block in other machining fixtures at the engine block machining plant. The OP10 fixture is typically present at the engine block machining plant, while the "qualification" fixture is typically present at the foundry producing the cast blocks. The purpose of either fixture is to provide qualified locator surfaces on the cast engine block. The features on the casting which position the casting in the OP10 or qualification fixture are known as "casting locators". Typically, the OP10 or qualification fixture for V-blocks with cast-in-place bore liners uses as casting locators the curved inside surface of at least one cylinder bore liner from each bank of cylinders. Using curved surfaces as casting locators is disadvantageous because moving the casting in a single direction causes a complex change in spatial orientation of the casting. This is further compounded by using at least one liner surface from each bank, as the banks are aligned at an angle to one another. As a practical matter, machinists prefer to design fixtures that first receive and support a casting on three "primary" casting locators that establish a reference plane. The casting then is moved against two "secondary" casting locators, establishing a reference line. Finally, the casting is moved along that line until a single "tertiary" casting locator establishes a reference point. The orientation of the casting is now fully established. The casting is then clamped in place while machining is performed. The use of curved and angled surfaces to orient the casting in the OP10 or "qualification" fixture can result in less precise positioning in the fixture and ultimately in less precise machining of the cast V-block, because the result of moving the casting in a given direction, prior to clamping in position for machining, is complex and potentially non-repeatable.

An object of the present invention is to provide method and apparatus for sand casting of engine cylinder blocks in a manner that overcomes one or more of the above disadvantages.

Another object of the invention is to use a core package including an integral barrel crankcase core in the production of aluminum and other engine V-blocks that include cast-in-place bore liners in a manner that reduces contamination of the engine block casting by loose sand abraded off the cores during assembly.

SUMMARY OF THE INVENTION

The present invention involves method and apparatus for assembling sand cores of an engine block mold in a manner that reduces contamination of the engine block casting by loose sand abraded off the cores during assembly. Pursuant to an embodiment of the invention, an assembly of multiple cores (core package) is formed apart from a base core, and the core package is cleaned to remove loose sand therefrom. The cleaned core package then is positioned between the base core and the cover core to complete assembly of the engine block mold package.

The core package can include many of the individual cores used to assemble the engine block mold package. For example, the core package can include an integral barrel-crankcase core with cylinder bore liners on the barrels thereof, a water jacket slab core assembly, various internal cores, end cores, and side cores.

In an illustrative embodiment of the invention, individual cores of the engine block mold package are assembled on a temporary base to form the core package. The temporary base does not form a part of the final engine block mold package. The core package and the temporary base are separated, and the core package then is cleaned preferably by high velocity air directed to remove loose sand from the exterior and interior thereof. The cleaned core package then is positioned on the base core followed by assembly of the cover core to complete assembly of the engine block mold package.

Advantages and objects of the present invention will be better understood from the following detailed description of the invention taken with the following drawings.

DESCRIPTION OF THE INVENTION

Figure 1:
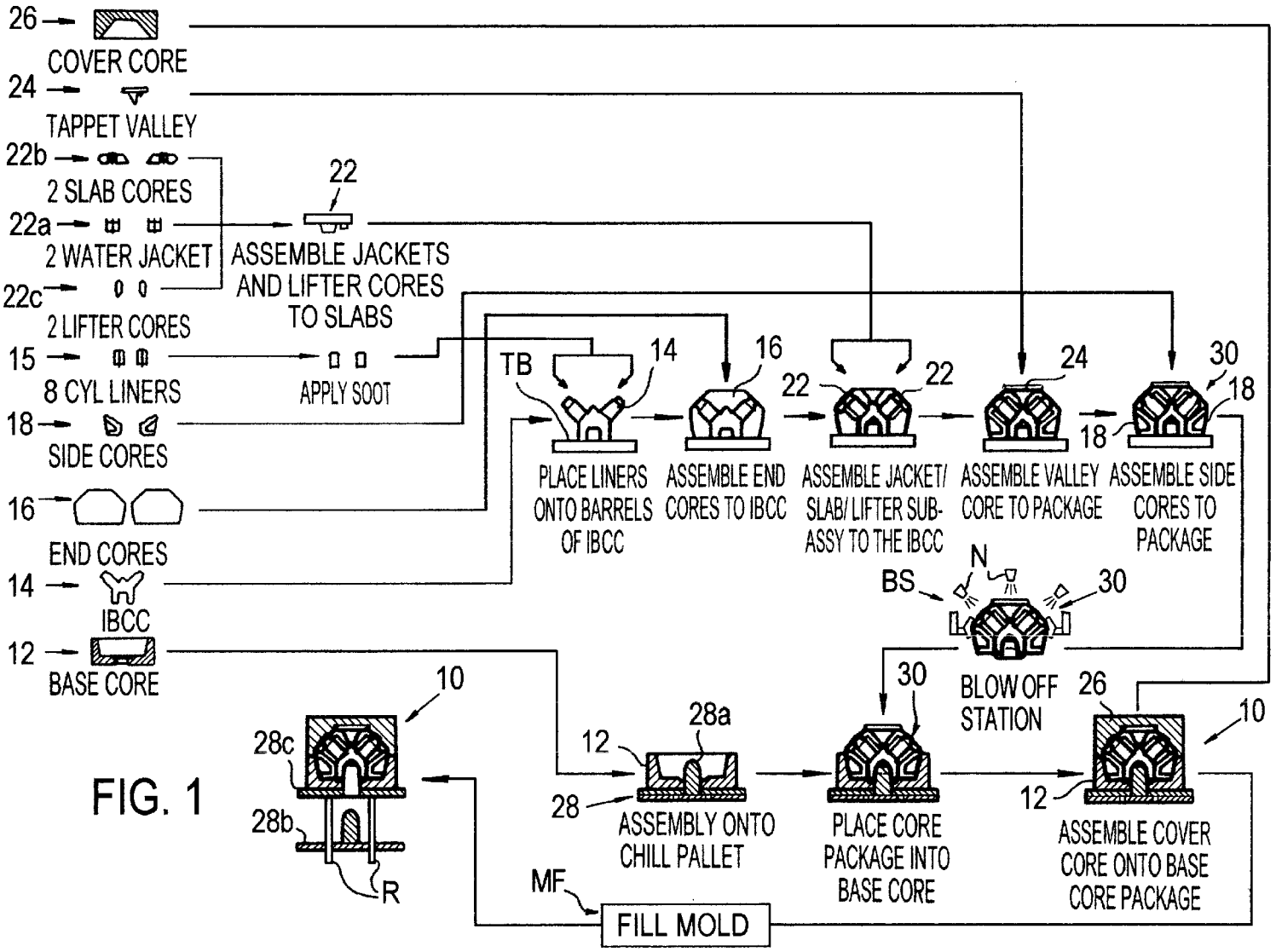
FIG. 1 is a flow diagram illustrating practice of an illustrative embodiment of the invention to assemble an engine V block mold package. The front end core is omitted from the views of the assembly sequence for convenience.
Figure 2:
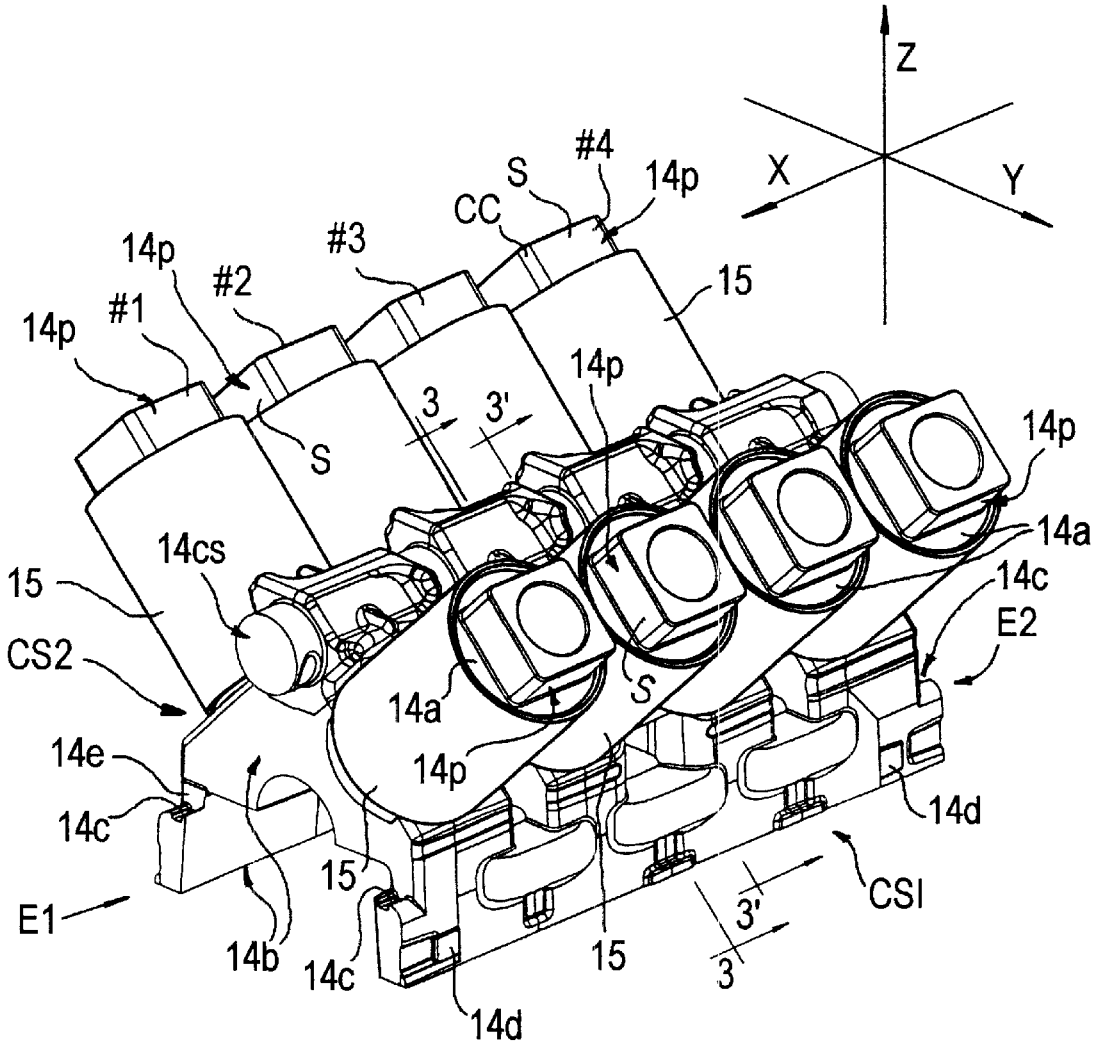
FIG. 2 is a perspective view of an integral barrel crankcase core having bore liners on barrels thereof and casting locator surfaces on the crankcase region pursuant to an embodiment of the invention.

FIG. 1 depicts a flow diagram showing an illustrative sequence for assembling an engine cylinder block mold package 10 pursuant to an embodiment of the invention. The invention is not limited to the sequence of assembly steps shown as other sequences can be employed to assemble the mold package.

The mold package 10 is assembled from numerous types of resin-bonded sand cores including a base core 12 mated with an optional chill 28*a*, optional chill pallet 28*b*, and optional mold stripping plate 28*c*, an integral barrel crankcase core (IBCC) 14 having metal (e.g. cast iron, aluminum, or aluminum alloy) cylinder bore liners 15 thereon, two end cores 16, two side cores 18, two water jacket slab core assemblies 22 (each assembled from a water jacket core 22*a*, jacket slab core 22*b*, and a lifter core 22*c*), tappet valley core 24, and a cover core 26. The cores described above are offered for purposes of illustration and not limitation as other types of cores and core configurations may be used in assembly of the engine cylinder block mold package depending upon the particular engine block design to be cast.

The resin-bonded sand cores can be made using conventional core-making processes such as a phenolic urethane cold box or Furan hot box where a mixture of foundry sand and resin binder is blown into a core box and the binder cured with either a catalyst gas and/or heat. The foundry sand can comprise silica, zircon, fused silica, and others. A catalyzed binder can comprise Isocure binder available from Ashland Chemical Company.

For purposes of illustration and not limitation, the resin-bonded sand cores are shown in FIG. 1 for use in assembly of an engine cylinder block mold package to cast an aluminum engine V8-block. The invention is especially useful, although not limited to, assembling mold packages 10 for precision sand casting of V-type engine cylinder blocks that comprise two rows of cylinder bores with planes through the centerlines of the bores of each row intersecting in the crankcase portion of the engine block casting. Common configurations include V6 engine blocks with 54, 60, 90, or 120 degrees of included angle between the two rows of cylinder bores and V8 engine blocks with a 90 degree angle between the two rows of cylinder bores, although other configurations may be employed.

The cores 14, 16, 18, 22, and 24 initially are assembled apart from the base core 12 and cover core 26 to form a subassembly 30 of multiple cores (core package), FIG. 1. The cores 14, 16, 18, 22, and 24 are assembled on a temporary base or member TB that does not form a part of the final engine block mold package 10. The cores 14, 16, 18, 22, and 24 are shown schematically in FIG. 1 for convenience with more detailed views thereof in FIGS. 2–5.

As illustrated in FIG. 1, integral barrel crankcase core 14 is first placed on the temporary base TB. The core 14 includes a plurality of cylindrical barrels 14*a* on an integral crankcase core region 14*b* as shown in FIGS. 2–3 and 5–6. The barrel crankcase core 14 is formed as an integral, one-piece core having the combination of the barrels and the crankcase region in core box tooling 100 shown in FIGS. 5–6. A cam shaft passage-forming region 14*cs* may also be integrally formed on the crankcase region 14*b*.

The core box tooling 100 comprises a base 102 on which first and second barrel-forming tool elements 104 are slidably disposed on guide pins 105 for movement by respective hydraulic cylinders 106. A cover 107 is disposed on a vertically movable, accurately guided core machine platen 110 for movement by a hydraulic cylinder 109 toward the barrel-forming tool elements 104. The elements 104 and cover 107 are moved from the solid positions of FIG. 5 to the dashed line positions to form a cavity C into which the sand/binder mixture is blown and cured to form the core 14. The ends of the core 14 are shaped by tool elements 104 and/or 107. The core 14 then is removed from the tooling 100 by moving the tool elements 104 and cover 107 away from one another to expose the core 14, the crankcase region 14*b* of which is shown somewhat schematically in FIG. 6 for convenience.

Figure 5:
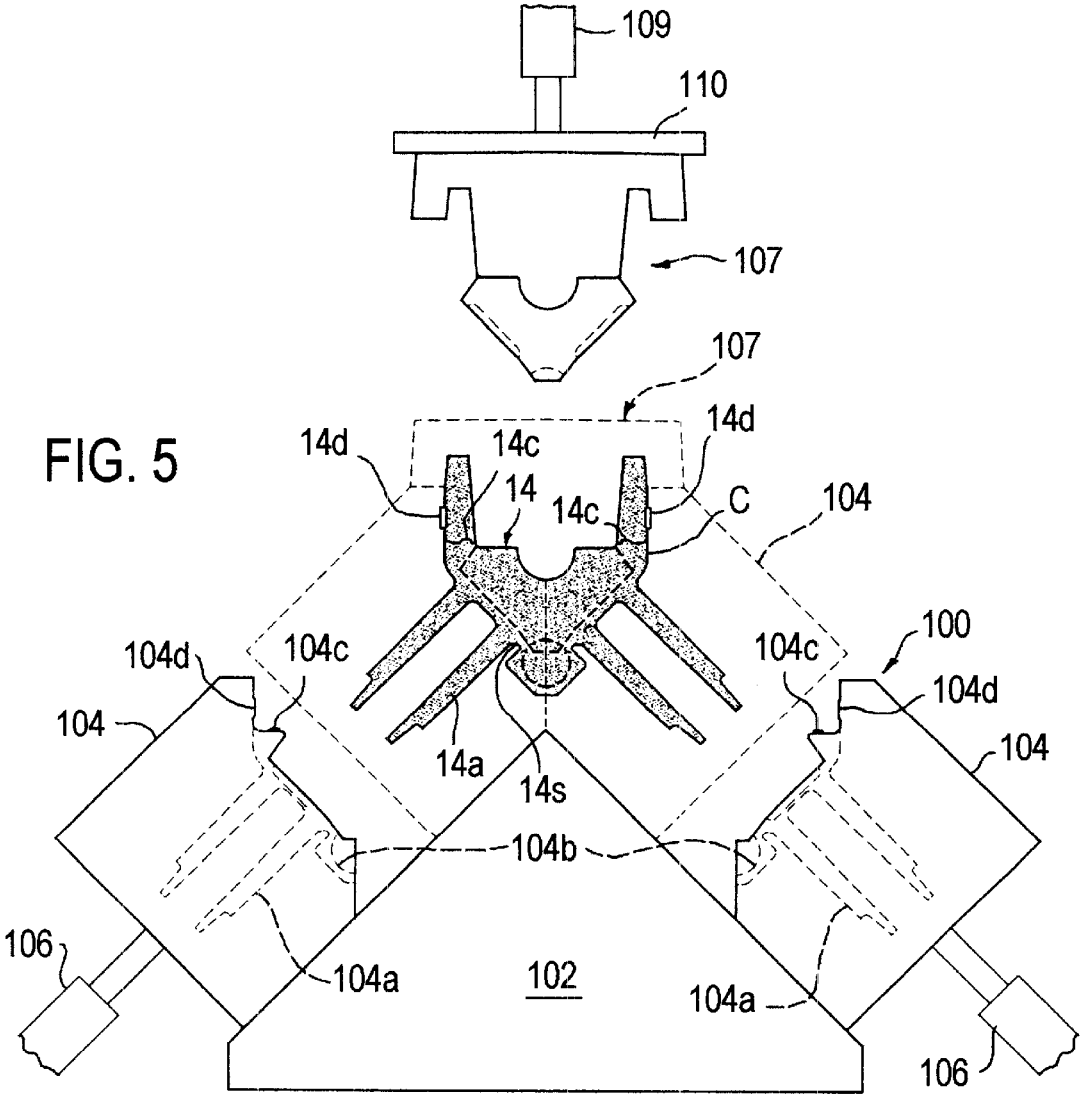
FIG. 5 is a schematic view of core box tooling for making the integral barrel crankcase core of FIG. 2 showing closed and open positions of the barrel-forming tool elements.
Figure 6:
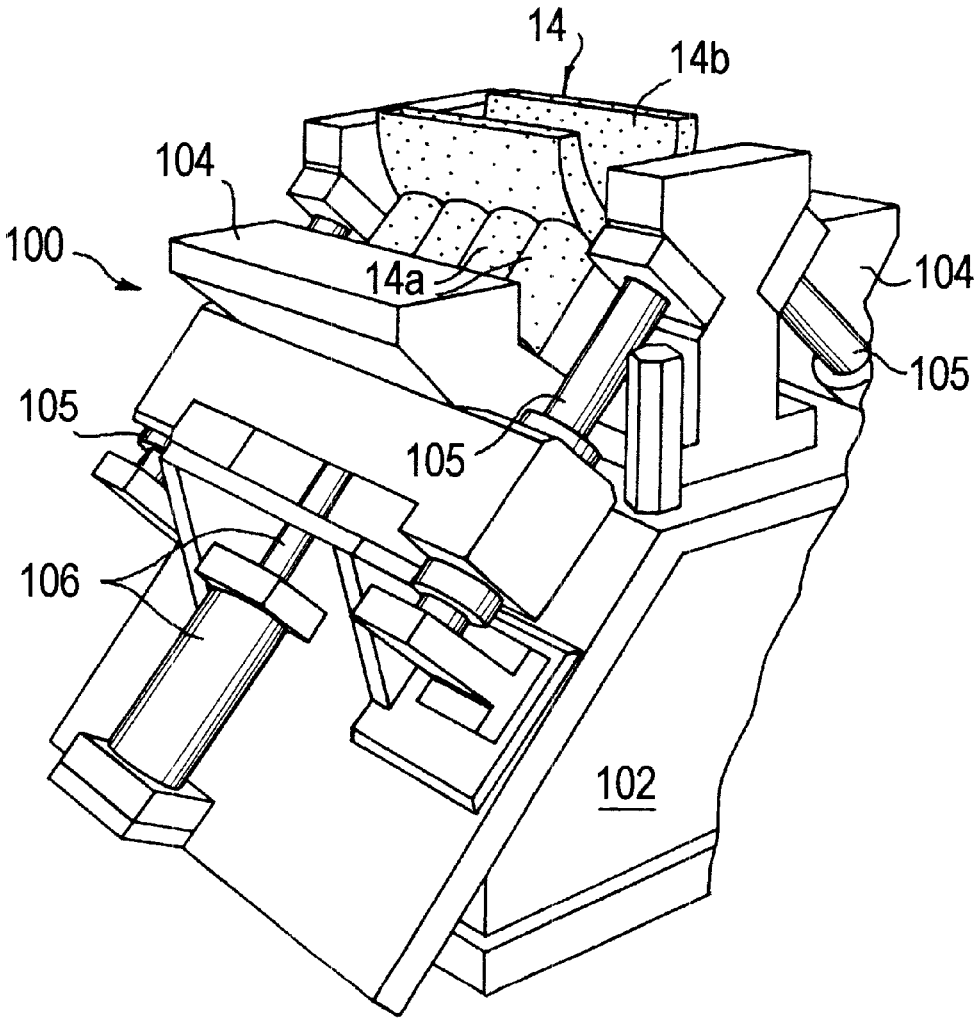
FIG. 6 is a partial perspective view of core box tooling and resulting core showing open positions of the barrel-forming tool elements.

The barrel-forming tool elements 104 are configured to form the barrels 14*a* and some exterior crankcase core surfaces, including casting locator surfaces 14*c*, 14*d*, and 14*e*. The cover 107 is configured to shape interior and other exterior crankcase surfaces of the core 14. For purposes of illustration and not limitation, the tool elements 104 are shown including working surfaces 104*c* for forming two primary casting locator surfaces 14*c*. These two primary locator surfaces 14*c* can be formed at one end E1 of the crankcase region 14*b* and a third similar locator surface (not shown but similar to surfaces 14*c*) can be formed at the other end E2 of the crankcase region 14*b*, FIG. 2. Three primary casting locator surfaces 14*c* establish a reference plane for use in known 3–2–1 casting location method. Two casting secondary locator surfaces 14*d* can be formed on one side CS1 of the crankcase region 14*b*, FIG. 2, of the core 14 to establish a reference line. The right-hand tool element 104 in FIG. 5 is shown including working surfaces 104*d* (one shown) for forming secondary locator surfaces 14*d* on side CS1 of the core 14. The left-hand tool element 104 optionally can include similar working surfaces 104*d* (one shown) to optionally form secondary locating surfaces 14*d* on the other side CS2 of the core 14. A tertiary casting locator surface 14*e* adjacent locator surface 14*c*, FIG. 2, can be formed on the end E1 of crankcase region 14*b* by the same tool element that forms locator surface 14*c* at core end E1. The single tertiary locator surface 14*e* establishes a reference point. The six locating surfaces 14*c*, 14*d*, 14*e* will establish the three axis coordinate system for locating the cast engine block for subsequent machining operations.

In actual practice, more than six such casting locator surfaces may used. For example, a pair of geometrically opposed casting locator surfaces may optionally be "equalized" to function as a single locating point in the six point (3+2+1) locating scheme. Equalization is typically accomplished by the use of mechanically synchronized positioning details in the OP10 or qualification fixture. These positioning details contact the locator surface pairs in a manner that averages, or equalizes, the variability of the two surfaces. For example, an additional set of secondary locator surfaces similar to locator surfaces 14*d* optionally can be formed on the opposite side CS2 of the core 14 by working surfaces 104*d* of the left-hand barrel forming tool element 104 in FIG. 5. Moreover, additional primary locator and tertiary locator surfaces can be formed as well for a particular engine block casting design.

The locator surfaces 14*c*, 14*d*, 14*e* can be used to orient the engine block casting in subsequent aligning and machining operations without the need to reference one or more curved surfaces of two or more of the cylinder bore liners 15.

Since the locator surfaces 14*c*, 14*d*, 14*e* are formed on the crankcase core region 14*b* using the same core box barrel-forming tool elements 104 that also form the integral barrels 14*a*, these locator surfaces are consistently and accurately positioned relative to the barrels 14*a* and thus the cylinder bores formed in the engine block casting.

As mentioned above, the integral barrel crankcase core 14 is first placed on the temporary base TB. Then, a metal cylinder bore liner 15 is placed manually or robotically on each barrel 14*a* of the core 14. Prior to placement on a barrel 14*a*, each liner exterior surface may be coated with soot comprising carbon black, for the purpose of encouraging intimate mechanical contact between the liner and the cast metal. The core 14 is made in core box tooling 100 to include a chamfered (conical) lower annular liner positioning surface 14*f* at the lower end of each barrel 14*a* as shown best in FIG. 3A. The chamfered surface 14*f* engages the chamfered annular lower end 15*f* of each bore liner 15 as shown in FIG. 3A to position it relative to the barrel 14*a* before and during casting of the engine block.

Figure 3:
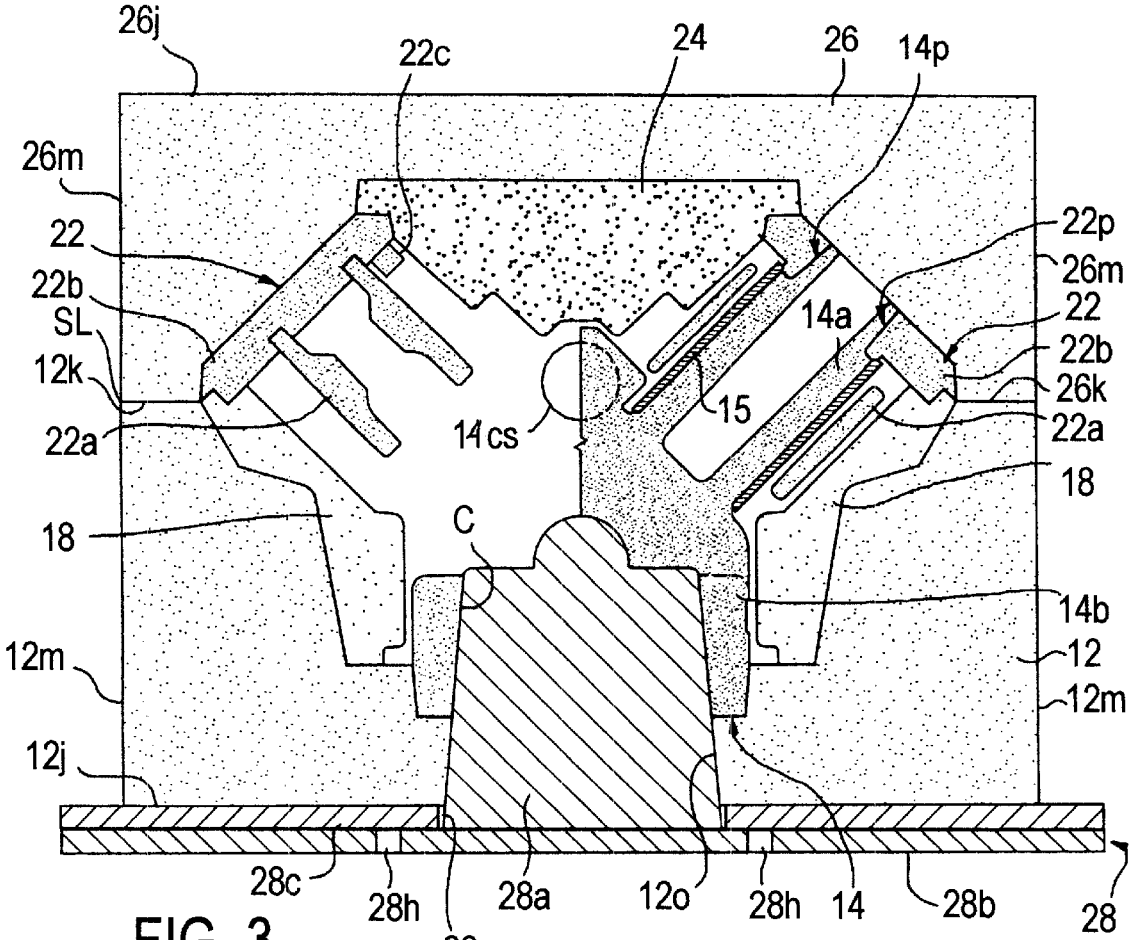
FIG. 3 is a sectional view of an engine block mold package pursuant to an embodiment of the invention where the right-hand cross-section of the barrel crankcase core is taken along lines 3—3 of FIG. 2 through a central plane of a barrel feature and where the left hand cross-section of the barrel crankcase core is taken along lines 3'—3' of FIG. 2 between adjacent barrels.
Figure 3A:
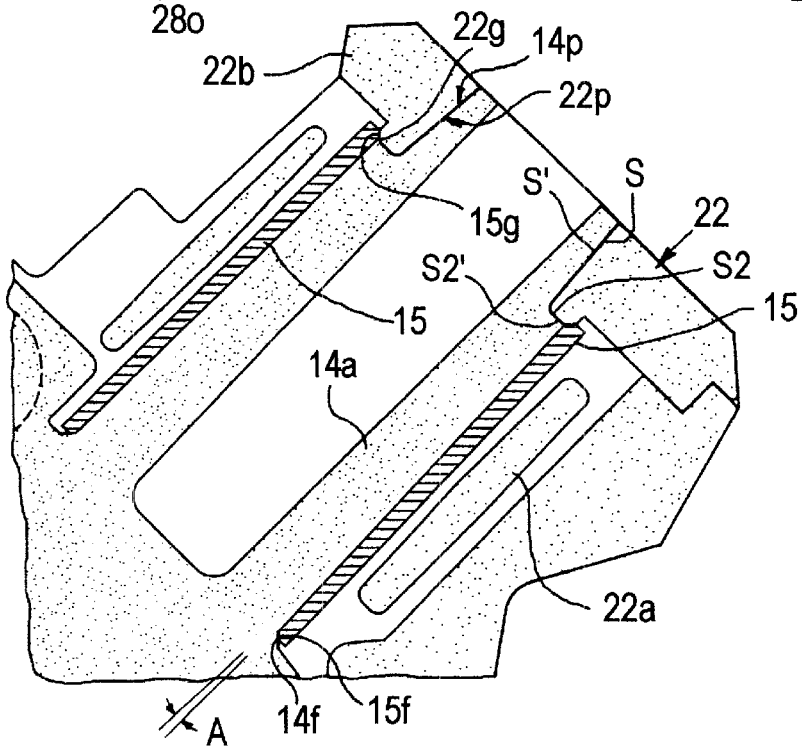
FIG. 3A is an enlarged sectional view of a barrel of the barrel crankcase core and a water jacket slab core assembly showing a cylinder bore liner on the barrel.

The cylinder bore liners 15 each can be machined or cast to include an inside diameter that is tapered along the entire length, or a portion of the length, of the bore liner 15 to conform to a draft angle A (outside diametral taper), FIG. 3A, present on the barrels 14*a* to permit removal of the core 14 from the core box tooling 100 in which it is formed. In particular, each barrel-forming element 104 of tooling 100 includes a plurality of barrel-forming cavities 104*a* having a slight reducing taper of the inside diameter along the length in a direction extending from the crankcase-forming region 104*b* thereof toward the distal ends of barrel-forming cavities 104*a* to permit movement of the tool elements 104 away from the cured core 14 residing in tooling 100; i.e., movement of the tool elements 104 from the dashed line positions to the solid positions of FIG. 5. The outside diametral taper of the formed core barrels 14*a* thus progresses (reduces in diameter) from proximate the core crankcase region 14*b* toward the distal ends of the barrels. The taper on the outside diameter of the barrels 14*a* typically is up to 1 degree and will depend upon the draft angle used on the barrel-forming tool elements 104 of core box tooling 100. The taper of the inside diameter of the bore liners 15 is machined or cast to be complementary to the draft angle (outside diametral taper) of barrels 14*a*, FIG. 3A, such that the inside diameter of each bore liner 15 is lesser at the upper end than at the lower end thereof, FIG. 3A. Tapering of the inside diameter of the bore liners 15 to match that of the outside diameter of the barrels 14*a* improves initial alignment of each bore liner on the associated barrel and thus with respect to water jacket slab core 22 that will be fitted on the barrels 14*a*. The matching taper also reduces, and makes uniform in thickness, the space or gap between each bore liner 15 and associated barrel 14*a* to reduce the likelihood and extent to which molten metal might enter the space during casting of the engine block mold. The taper on the inside diameter of the bore liners 15 is removed during machining of the engine block casting.

Figure 3B:
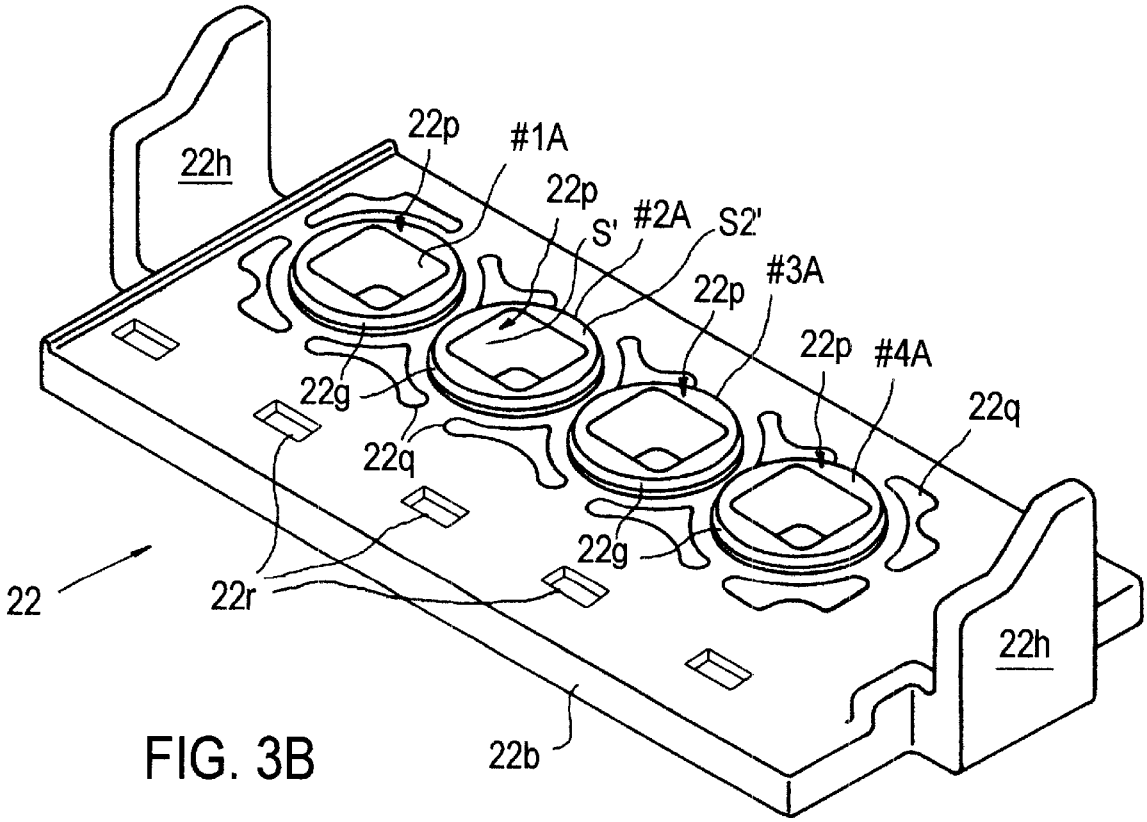
FIG. 3B is a perspective view of a slab core having core print features for engagement to core prints of the barrels, lifter core, water jacket core, and end cores.
Figure 3C:
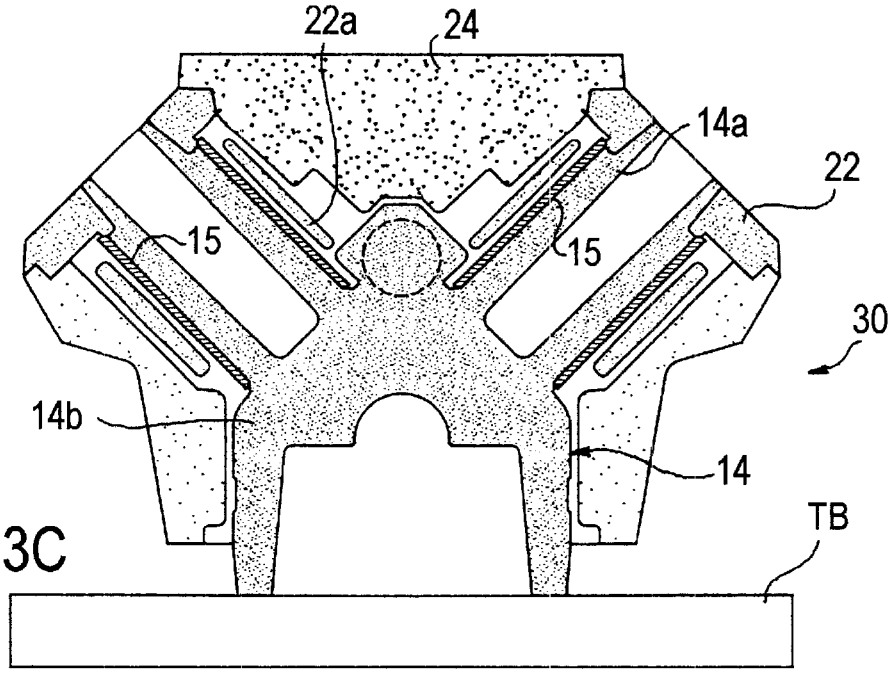
FIG. 3C is a sectional view of a subassembly (core package) of cores residing on a temporary base.
Figure 3D:
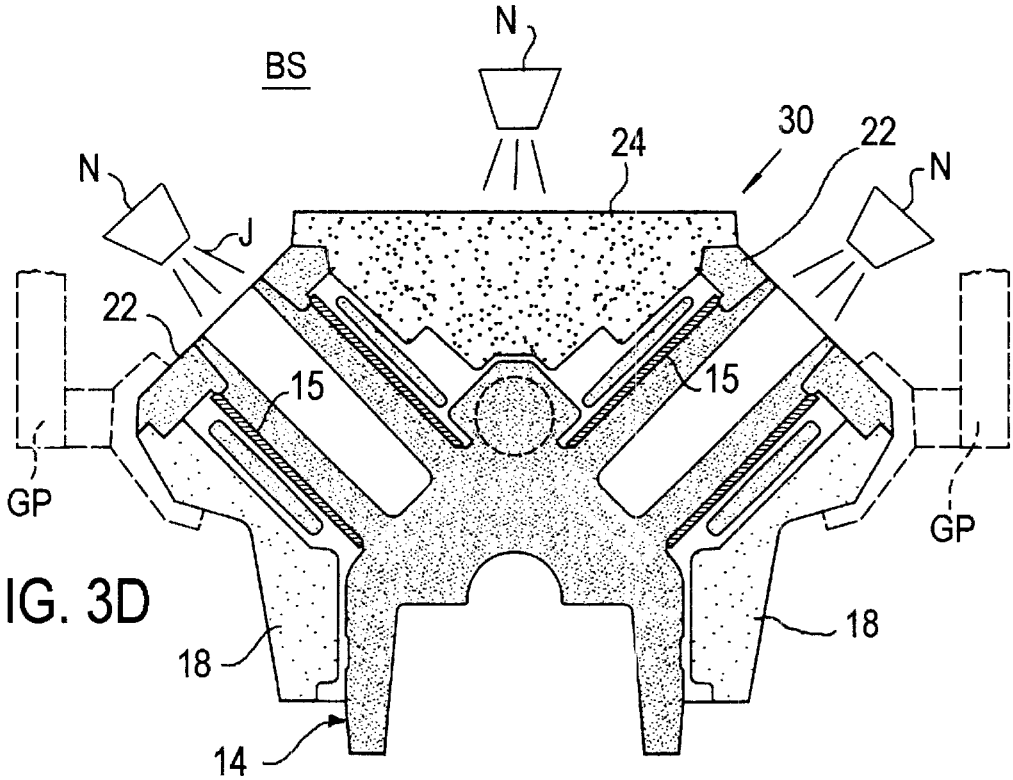
FIG. 3D is a sectional view of the subassembly (core package) positioned by a schematically shown manipulator at a cleaning station.
Figure 3E:
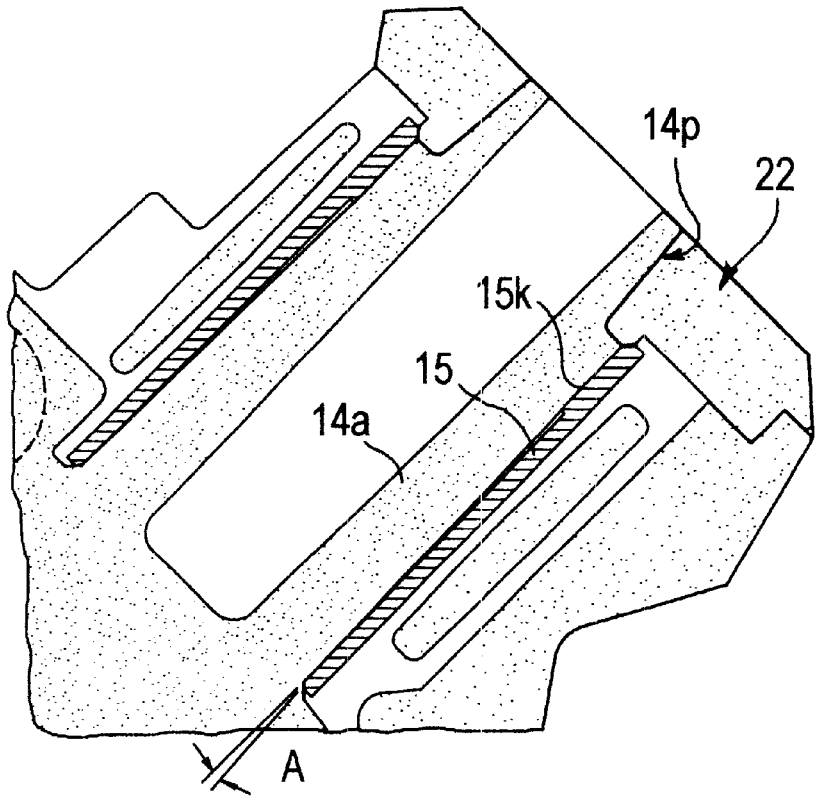
FIG. 3E is an enlarged sectional view of a barrel of the barrel crankcase core and a water jacket slab core showing a cylinder bore liner with a taper only on an upper portion of its length.

The inside diametral taper of the bore liners 15 may extend along their entire lengths as illustrated in FIG. 3 and 3A or only along a portion of their lengths as illustrated in FIG. 3E. For example, the inside diametral taper of each bore liner 15 can extend only along an upper tapered portion 15*k* of its length proximate a distal end of each said barrel 14*a* adjacent the core print 14*p* as illustrated in FIG. 3E proximate to where the upper end of the bore liner 15 mates with the water jacket slab core assembly 22. For example, the tapered portion 15*k* may have a length of one inch measured from its upper end toward its lower end. Although not shown, a similar inside diametral tapered region can be provided locally at the lower end of each bore liner 15 adjacent the crankcase region 14*b*, or at any other local region along the length of the bore liner 15 between the upper and lower ends thereof.

Figure 3F:
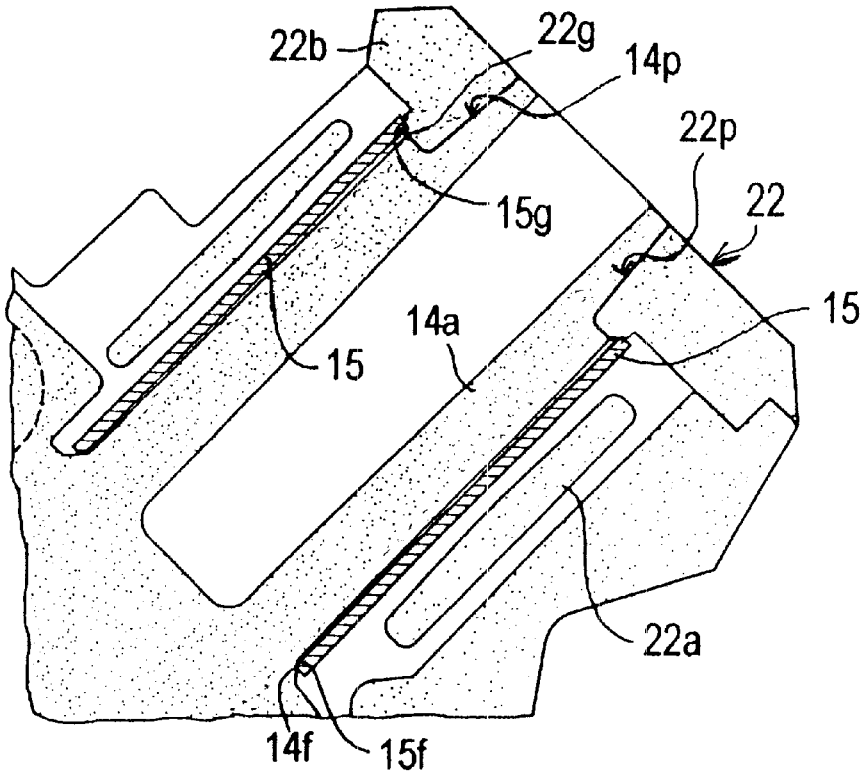
FIG. 3F is an enlarged sectional view of a barrel of the barrel crankcase core and a water jacket slab core showing an untapered cylinder bore liner on the barrel.

The invention is not limited to use of bore liners 15 with a slight taper of the inside diameter to match the draft angle of the barrels 14*a* since untapered cylinder bore liners 15 with constant inside and outside diameters can be used to practice the invention, FIG. 3F. The untapered bore liners 15 are positioned on barrels 14*a* by chamfered positioning surfaces 14*f*, 22*g* engaging chamfered bore liner surfaces 15*f*, 15*g* that are like surfaces 15*f*, 15*g* described herein for the tapered bore liners 15.

Following assembly of the bore liners 15 on the barrels 14*a* of core 14, the end cores 16 are assembled manually or robotically to core 14 using interfitting core print features on the mating cores to align the cores, and conventional means of attaching them, such as glue, screws, or other methods known to those experienced in the foundry art. A core print comprises a feature of a mold element (e.g. a core) that is used to position the mold element relative to other mold elements, and which does not define the shape of the casting.

After the end cores 16 are placed on the barrel crankcase core 14, a water jacket slab core assembly 22 is placed manually robotically on each row of barrels 14*a* of the core 14, FIG. 3. Each water jacket slab core assembly 22 is made by fastening a water jacket core 22*a* and a lifter core 22*c* to a slab core 22*b* using conventional interfitting core print features of the cores such as recesses 22*q* and 22*r* on the slab core 22*b*, FIG. 3B. These receive core print features of the water jacket core 22*a* and lifter core 22*c*, respectively. Means of fastening/securing the assembled cores include glue, screws, or other methods known to those experienced in the foundry art. Each water jacket slab core 22*b* includes end core prints 22*h*, FIG. 3B, that interfit with complementary features on the respective end cores 16. The intended function of core prints 22*h* is to pre-align the slab core 22*b* during assembly on the barrels and to limit outward movement of the end cores during mold filling. Core prints 22*h* do not control the position of slab core 22*b* relative to the integral barrel crankcase core 14 other than to reduce rotation of the slab core 22*b* relative to the barrels.

Water jacket slab core assemblies 22 are assembled on the rows of barrels 14*a* as illustrated in FIG. 3. At least some of the barrels 14*a* include a core print 14*p* on the upper, distal end thereof formed on the barrels 14*a* in the core box tooling 100, FIG. 2 and 5. In the embodiment shown for purposes of illustration only, all of the barrels 14*a* include a core print 14*p*. The elongated barrel core print 14*p* is illustrated as a flat-sided polygonal extension including four major flat sides S separated by chamfered corners CC and extending upwardly from an upwardly facing flat core surface S2. The water jacket slab core assembly 22 includes a plurality of complementary polygonal core prints 22*p* each comprising four major sides S1 extending from a downwardly facing core surface S2', FIG. 3A. The core prints 22*p* are illustrated as flat-sided openings to receive core prints 14*p* and having annular chamfered (conical) liner positioning surfaces 22*g* at their lower ends. When each core assembly 22 is positioned on each row of barrels 14*a*, each core print 14*p* of the barrels 14*a* is cooperatively received in a respective core print 22*p*. One or more of the flat major sides or surfaces of some of core prints 14*p* typically are tightly nested (e.g. clearance of less than 0.01 inch) relative to a respective core print 22*p* of the core assembly 22. For example only, the upwardly facing core surfaces S2 of the first barrel 14*a* (e.g. #1 in FIG. 2) and the last barrel 14*a* (e.g. #4) in a given bank of the barrels could be used to align the longitudinal axis of the water jacket slab core assembly 22 using downwardly facing surfaces S2' of the core prints (e.g. #1A and #4A in FIG. 3B) of assembly 22 parallel to an axis of that bank of barrels (the terms upwardly and downwardly facing being relative to FIG. 3A). The forward facing side S of core print 14*p* of the second barrel (e.g. #2 in FIG. 2) of a given bank of barrels could be used to position the core assembly 22 along the "X" axis, FIG. 2, using the rearwardly facing side S1 of core print 22*p* (e.g. #2A in FIG. 3B) of assembly 22.

As assembly of the jacket slab assembly 22 to the barrels nears completion, each chamfered surface 22*g* engages a respective chamfered upper annular end 15*g* of each bore liner 15 as shown in FIGS. 3 and 3A. The upper, distal ends of the bore liners 15 are thereby accurately positioned relative to the barrels 14*a* before and during casting of the engine block. Since the locations of the barrels 14*a* are accurately formed in core box tooling 100 and since the water jacket slab core 22 and barrels 14*a* are closely interfitted at some of the core prints 14*p*, 22*p*, the bore liners 15 are accurately positioned on the core 14 and thus ultimately the cylinder bores are accurately positioned in the engine block casting made in mold package 10.

Regions of the core prints 14*p* and 22*p* are shown as flat-sided polygons in shape for purposes of illustration only, as other core print shapes can be used. Moreover, although the core prints 22*p* are shown as flat-sided openings that extend from an inner side to an outer side of each core assembly 22, the core prints 22*p* may extend only part way through the thickness of the core assembly 22. Use of core print openings 22*p* through the thickness of core assembly 22 is preferred to provide maximum contact between the core prints 14*p* and the core prints 22*p* for positioning purposes. Those skilled in the art will also appreciate that core prints 22*p* can be made as male core prints that are each received in a respective female core print on upper, distal end of each barrel 14*a*.

Following assembly of the water jacket slab core assemblies 22 on the barrels 14*a*, the tappet valley core 24 is assembled manually or robotically on the water jacket slab core assemblies 22 followed by assembly of the side cores 18 on the crankcase barrel core 14 to form the subassembly (core package) 30, FIG. 1, on the temporary base TB. The base core 12 and the cover core 26 are not assembled at this point in the assembly sequence.

The subassembly (core package) 30 and the temporary base TB then are separated by lifting the subassembly 30 using a robotic gripper GP or other suitable manipulator, FIG. 3D, off of the base TB at a separate station. The temporary base TB is returned to the starting location of the subassembly sequence where a new integral barrel crankcase core 14 is placed thereon for use in assembly of another subassembly 30.

The subassembly 30 is taken by robotic gripper GP or other manipulator to a cleaning (blow off) station BS, FIGS. 1 and 3D, where it is cleaned to remove loose sand from the exterior surfaces of the subassembly and from interior spaces between the cores thereof. The loose sand typically is present as a result of the cores rubbing against one another at the joints therebetween during the subassembly sequence described above. A small amount of sand can be abraded off of the mating joint surfaces and lodge on the exterior surfaces and in narrow spaces between adjacent cores, such narrow spaces forming the walls and other features of the engine block casting where their presence can contaminate the engine block casting made in the mold package 10.

The cleaning station BS can comprise a plurality of high velocity air nozzles N in front of which the subassembly 30 is manipulated by the robotic gripper GP such that high velocity air jets J from nozzles N impinge on exterior surfaces of the subassembly and into the narrow spaces between adjacent cores to dislodge any loose sand particles and blow them out of the subassembly as assisted by gravity forces on the loose sand particles. In lieu of, or in addition to, moving the subassembly 30, the nozzles N may be movable relative to the subassembly to direct high velocity air jets at the exterior surfaces of the subassembly and into the narrow spaces between adjacent cores. The invention is not limited to use of high velocity air jets to clean the subassembly 30 since cleaning may be conducted using one or vacuum cleaner nozzles to suck loose particles off of the subassembly.

Figure 4:
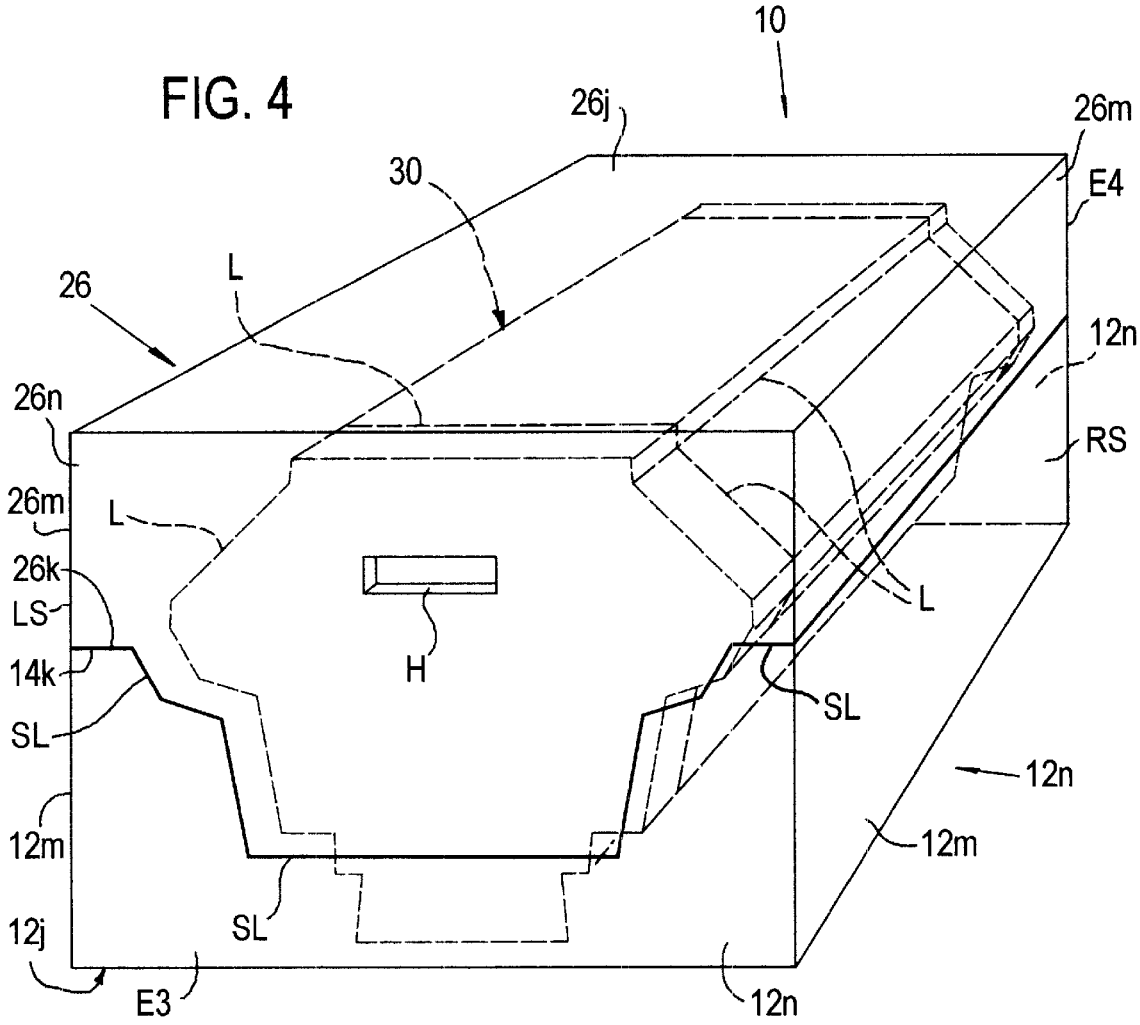
FIG. 4 is a perspective view of the engine block mold after the subassembly (core package) has been placed in the base core and the cover core is placed on the base core with chills omitted.

The cleaned subassembly (core package) 30 includes multiple parting lines L on exterior surfaces thereof, the parting lines being disposed between the adjacent cores at joints therebetween and extending in various different directions on exterior surfaces as schematically illustrated in FIG. 4.

The cleaned subassembly (core package) 30 then is positioned by robotic gripper GP on base core 12 residing on optional chill pallet 28, FIGS. 1 and 3. Chill pallet 28 includes mold stripper plate 28*c* disposed on pallet plate 28*b* to support base core 12, FIG. 3. The base core 12 is placed on the chill pallet 28 having a plurality of upstanding chills 28*a* (one shown) that are disposed end-to-end on a lowermost pallet plate 28*b*. The chills 28*a* can be fastened together end-to-end by one or more fastening rods (not shown) that extend through axial passages in the chills 28*a* in a manner that the ends of the chills can move toward one another to accommodate shrinkage of the metal casting as it solidified and cools. The chills 28*a* extend through an opening 28*o* in mold stripper plate 28*c* and an opening 120 in the base core 12 into the cavity C of the crankcase region 14*b* of the core 14 as shown in FIG. 3. The pallet plate 28*b* includes through holes 28*h* through which rods R, FIG. 1, can be extended to separate the chills 28*a* from the mold stripper plate 28*c* and mold package 10. The chills 28*a* are made of cast iron or other suitable thermally conductive material to rapidly remove heat from the bulkhead features of the casting, the bulkhead features being those casting features that support the engine crankshaft via the main bearings and main bearing caps. The pallet plate 28*b* and the mold stripper plate 28*c* can be constructed of steel, thermal insulating ceramic plate material, combinations thereof, or other durable material. Their function is to facilitate the handling of the chills and mold package, respectively. They typically are not intended to play a significant role in extraction of heat from the casting, although the invention is not so limited. The chills 28*a* on pallet plate 28*b* and mold stripper plate 28*c* are shown for purposes of illustration only and may be omitted altogether, depending upon the requirements of a particular engine block casting application. Moreover, the pallet plate 28*b* can be used without the mold stripper plate 28*c*, and vice versa, in practice of the invention.

Cover core 26 then is placed on the base core 12 and subassembly (core package) 30 to complete assembly of the engine block mold package 10. Any additional cores (not shown) not part of subassembly (core package) 30 can be placed on or fastened to the base core 12 and cover core 26 before they are moved to the assembly location where they are united with the subassembly (core package) 30. For example, pursuant to an assembly sequence different from that of FIG. 1, core package 30 can be assembled without side cores 16, which instead are assembled on the base core 12. The core package 30 sans side cores 16 is subsequently placed in the base core 12 having side cores 16 therein. The base core 12 and cover core 26 have inner surfaces that are configured complementary and in close fit to the exterior surfaces of the subassembly (core package 30). The exterior surfaces of the base core and cover core are illustrated in FIG. 4 as defining a flat-sided box shape but can be any shape suited to a particular casting plant. The base core 12 and cover core 26 typically are joined together with core package 30 therebetween by exterior peripheral metal bands or clamps (not shown) to hold the mold package 10 together during and immediately following mold filling.

Location of the subassembly 30 between base core 12 and cover core 26 is effective to enclose the subassembly 30 and confine the various multiple exterior parting lines L thereon inside of the base core and cover core, FIG. 4. The base core 12 and cover core 26 include cooperating parting surfaces 14*k*, 26*k* that form a single continuous exterior parting line SL extending about the mold package 10 when the base core and cover core are assembled with the subassembly (core package) 30 therebetween. A majority of the parting line SL about the mold package 10 is oriented in a horizontal plane. For example, the parting line SL on the sides LS, RS of the mold package 10 lies in a horizontal plane. The parting line SL on the ends E3, E4 of the mold package 10 extends horizontally and non-horizontally to define a nesting tongue and groove region at each end E3, E4 of the mold package 10. Such tongue and groove features may be required to accommodate the outside shape of the core package 30, thus minimizing void space between the core package and the base and cover cores 12, 26, to provide clearance for the mechanism used to lower the core package 30 into position in the base core 12, or to accommodate an opening through which molten metal is introduced to the mold package. The opening (not shown) for molten metal may be located at the parting line SL or at another location depending upon the mold filling technique employed to provide molten metal to the mold package, which mold filling technique forms no part of the invention. The continuous single parting line SL about the mold package 10 reduces the sites for escape of molten metal (e.g. aluminum) from the mold package 10 during mold filling.

The base core 12 includes a bottom wall 12*j*, a pair of upstanding side walls 12*m* joined by a pair of upstanding opposite end walls 12*n*, FIG. 4. The side walls and end walls of the base core 12 terminate in upwardly facing parting surface 14*k*. The cover core includes a top wall 26*j*, a pair of depending side walls 26*m* joined by a pair of depending opposite end walls 26*n*. The side and end walls of the cover core terminate in downwardly facing parting surface 26*k*. The parting surfaces 12*k*, 26*k* mate together to form the mold parting line SL when the base core 12 and cover core 26 are assembled with the subassembly (core package) 30 therebetween. The parting surfaces 14*k*, 26*k* on the sides LS, RS of the mold package 10 are oriented solely in a horizontal plane, although the parting surfaces 12*k*, 26*k* on the end walls E3, E4 of the mold package 10 could reside solely in a horizontal plane.

The completed engine block mold package 10 then is moved to a mold filling station MF, FIG. 1, where it is filled with molten metal such as molten aluminum using in an illustrative embodiment of the invention a low pressure filling process with the mold package 10 inverted from its orientation in FIG. 1, although any suitable molding filling technique such as gravity pouring, may be used to fill the mold package. The molten metal (e.g. aluminum) is cast about the bore liners 15 prepositioned on the barrels 14*a* such that when the molten metal solidifies, the bore liners 15 are cast-in-place in the engine block. The mold package 10 can include recessed manipulator-receiving pockets H, one shown in FIG. 4, formed in the end walls of the cover core 26 by which the mold package 10 can be gripped and moved to the filling station MF.

During casting of molten metal in the mold package 10, each bore liner 15 is positioned at its lower end by engagement between the chamfer 14*f* on the barrel 14*a* and the chamfered surface 15*f* on the bore liner and at its upper distal end by engagement between the chamfered surface 22*g* on the water jacket slab core assembly 22 and the chamfered surface 15*g* on the bore liner. This positioning keeps each bore liner 15 centered on its barrel 14*a* during assembly and casting of the mold package 10 when the bore liner 15 is cast-in-place in the cast engine block to provide accurate cylinder bore liner position in the engine block. This positioning in conjunction with use of tapered bore liners 15 to match the draft of the barrels 14*a* also can reduce entry of molten metal into the space between the bore liners 15 and the barrels 14*a* to reduce formation of metal flash therein optionally, a suitable sealant can be applied to some or all of the chamfered surfaces 14*f*, 15*f*, 22*g*, and 15*g* to this end as well when the bore liners 15 are assembled on the barrels 14*a* of core 14, or when the jacket slab assembly 22 is assembled to the barrels.

The engine block casting (not shown) shaped by the mold package 10 will include cast-on primary locator surfaces, secondary locator surfaces and optional tertiary locator surface formed by the respective primary locator surfaces 14*c*, secondary locator surfaces 14*d*, and tertiary locator surface 14*e* provided on the crankcase region 14*b* of the integral barrel crankcase core 14. The six locating surfaces on the engine block casting are consistently and accurately positioned relative to the cylinder bore liners cast-in-place in the engine block casting and will establish a three axis coordinate system that can be used to locate the engine block casting in subsequent aligning (e.g. OP10 alignment fixture) and machining operations without the need to locate on the curved cylinder bore liners 15.

After a predetermined time period following casting of molten metal into the mold package 10, it is moved to a next station illustrated in FIG. 1 where vertical lift rods R are raised through holes 28*h* of pallet plate 28*b* to raise and separate the mold stripper plate 28*c* with the cast mold package 10 thereon from the pallet plate 28*b* and chills 28*a* thereon. Pallet plate 28*b* and chills 28*a* can be returned to the beginning of the assembly process for reuse in assembling another mold package 10. The cast mold package 10 then can be further cooled on the stripper plate 28*c*. This further cooling of the mold package 10 can be accomplished by directing air and/or water onto the now exposed bulkhead features of the casting. This can further enhance the material properties of the casting by providing a cooling rate greater than can be achieved by the use of a thermal chill of practical size. Thermal chills become progressively less effective with the passage of time, due to the rise in the temperature of the chill and the reduction in casting temperature. After removal of the cast engine block from the mold package by conventional techniques, the inside diametral taper, if present, on the inside diameter of the bore liners 15 is removed during subsequent machining of the engine block casting to provide a substantially constant inside diameter on the bore liners 15.

While the invention has been described in terms of specific embodiments thereof, it is not intended to be limited thereto but rather only to the extent set forth in the following claims.

What is claimed is:

1. Method of assembling sand cores of an engine block mold package, comprising assembling multiple sand cores of said mold package to provide an assembly, cleaning said assembly to remove loose sand therefrom, and disposing the cleaned assembly between a base core and a cover core.

2. The method of claim 1 including forming said assembly by assembling said multiple cores on a temporary base apart from said base core.

3. The method of claim 2 including the step of separating said assembly of said multiple cores from said temporary base before said assembly is cleaned.

4. The method of claim 1 wherein said assembly is cleaned by impinging it with one or more air jets.

5. The method of claim 4 wherein said assembly is moved by a manipulator while being impinged with said air jets.

6. Method of assembling sand cores of an engine V block mold package, comprising assembling multiple sand cores of said V block mold package to provide an assembly, cleaning said assembly to remove loose sand therefrom, positioning the cleaned assembly on a base core, and positioning a cover core on said base core.

7. Apparatus for assembling sand cores of an engine block mold package, comprising a temporary base on which an assembly of multiple sand cores of said mold package is disposed, a cleaning station having means for removing loose sand from said assembly, and a manipulator for separating said assembly from said temporary base and moving said assembly to said cleaning station where said assembly is cleaned to remove loose sand therefrom.

8. The apparatus of claim 7 wherein said cleaning station includes a nozzle for discharging a gas jet at said assembly to blow loose sand off of said assembly.

9. The apparatus of claim 7 wherein said nozzle discharges an air jet to blow loose sand off of said assembly.

10. An engine block mold package, comprising a base core, a cover core, and an assembly of multiple sand cores, said assembly being disposed between said base core and said cover core and having been cleaned to remove loose sand before positioning between said base core and said cover core.

11. The mold package of claim 10 which forms an engine V block mold package.

12. Method of assembling sand cores of an engine block mold package, comprising assembling multiple sand cores of said block mold package to provide an assembly, providing a base core having a bottom opening for receiving a chill, cleaning said assembly to remove loose sand therefrom, and assembling the cleaned assembly between said base core and a cover core.

13. The method of claim 12 wherein the loose sand is blown off of said assembly.

* * * * *